United States Patent [19]

Harris et al.

[11] Patent Number: 4,631,883

[45] Date of Patent: Dec. 30, 1986

[54] TENDONS FOR POST-TENSIONED PRE-STRESSED CONCRETE STRUCTURES

[75] Inventors: Alan J. Harris, London; Gordon E. R. Wright, Great Missenden, both of England

[73] Assignee: PSC Freyssinet Limited, Buckinghamshire, England

[21] Appl. No.: 611,199

[22] Filed: May 17, 1984

[30] Foreign Application Priority Data

May 25, 1983 [GB] United Kingdom ..... 8314417

[51] Int. Cl.[4] ..... E04C 3/10

[52] U.S. Cl. ..... 52/223 R

[58] Field of Search ..... 156/294, 305, 330; 52/223 R, 230, 250–262; 405/260–262

[56] References Cited

U.S. PATENT DOCUMENTS

| | | | |
|---|---|---|---|
| 3,212,222 | 10/1965 | Wittfoht | 52/230 |
| 3,618,326 | 11/1971 | Montgomery | 405/261 |
| 3,657,379 | 4/1972 | Hilbelink et al. | 156/330 |
| 3,666,597 | 5/1972 | Parnell | 156/305 |
| 4,372,708 | 2/1983 | Bower et al. | 405/260 |
| 4,397,589 | 8/1983 | Darroussin et al. | 405/260 |

FOREIGN PATENT DOCUMENTS

| | | | |
|---|---|---|---|
| 157495 | 3/1952 | Australia | 52/230 |
| 193177 | 12/1964 | Sweden | 405/261 |
| 8380090 | 6/1960 | United Kingdom | 52/230 |

*Primary Examiner*—James L. Ridgill, Jr.

*Attorney, Agent, or Firm*—McCormick, Paulding & Huber

[57] ABSTRACT

A tendon for post-tensioned pre-stressed concrete structures in which between the strand and sheath there is provided, in quiescent condition, a latent hardenable material and an activator therefor so that when the strand is tensioned the activator is activated to commence the hardening process of the hardenable material and produce a bonded tendon.

8 Claims, 3 Drawing Figures

TENDONS FOR POST-TENSIONED PRE-STRESSED CONCRETE STRUCTURES

INTRODUCTION

This invention relates to tendons for post-tensioned pre-stressed concrete structures.

In this specification the word "strand" includes wire or bar or a plurality of strands, wires or bars.

PRIOR ART

It is well known in the field of post-tensioned pre-stressed concrete structures to provide a tendon which consists of a central strand around which a plastics sheath has been extruded or a metal sheath wound in the form of a helix, there being a lubricant, normally grease, between the strand and sheath to facilitate movement of the strand within the sheath on post-tensioning and for the strand to be afforded a degree of corrosion protection.

This form of tendon has many advantages but one main disadvantage; it is that there is no significant bond between the sheath and the surrounding concrete after post-tensioning. As a consequence of this, the developed ultimate strength in bending is about 20% less than that with bonded tendons. Also, cracks in overload tensile zones are bigger. Further, the maintenance of the tension in the strand depends solely on the anchorages and problems may arise when modifying or demolishing structures.

OBJECT OF THE INVENTION

It is the main object of this invention to provide a tendon for use in post-tensioned pre-stressed concrete structures which obviates or minimises the above disadvantages.

STATEMENTS OF INVENTION

According to the present invention there is provided a tendon for use in a post-tensioned pre-stressed concrete structure, comprising a high tensile steel strand (as herein defined) encased in a protective metal sheath, there being provided in quiescent condition between the strand and sheath a material having a latent hardening property and an activator therefor, the arrangement being such that by the strand being moved in relation to the sheath the activator is activated to induce hardening of the hardenable material.

Conveniently, the hardenable material is an epoxy resin.

The invention also includes a post-tensioned pre-stressed concrete structure having at least one tendon as specified above.

The invention further includes a tendon as recited above, in which the hardenable material is, in its quiescent condition, encapsulated in a myriad of small capsules around the strand. Such capsules may be suspended in a carrier which may be a solvent and dispersed around the strand with the activator. The activator may or may not be itself encapsulated and the invention visualises either the hardenable material or the activator or both of them being encapsulated.

Such capsules may be applied in any convenient manner around the strand, for example, by coating the strand by painting or spraying the capsules carried by a solvent onto the surface of the strand or onto the inside surface of the sheath. Alternatively, the capsules may be carried by a sheet of material which is wrapped helically around the strand.

The sheath may be helically formed with interlocking or lapped edges which extend inwardly to near the strand, which edges rupture the capsules on the strand being moved in relation to the sheath during tensioning.

DRAWINGS

SPECIFIC DESCRIPTION

Figure 1:
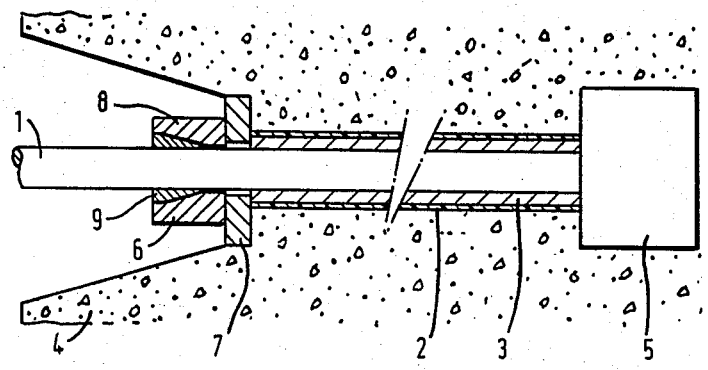
FIG. 1 is a diagrammatic cross-sectional view through a typical tendon in a concrete structure.

The general construction illustrated in FIG. 1 is well known in which a high tensile steel strand 1 is surrounded by a sheath 2 which may be of plastics or metal, there being a lubricant 3, which may be grease, between the two. The tendon is within a concrete structure 4 and passes through anchorages at 5 and 6 which include a bearing plate 7, an anchorage head 8 and gripping jaws 9. By means of a jacks, which bear on the anchorage heads 8, the strand 1 is post-tensioned and finally anchored. The anchorage 5 may be similar to the anchorage 6.

Figure 2:
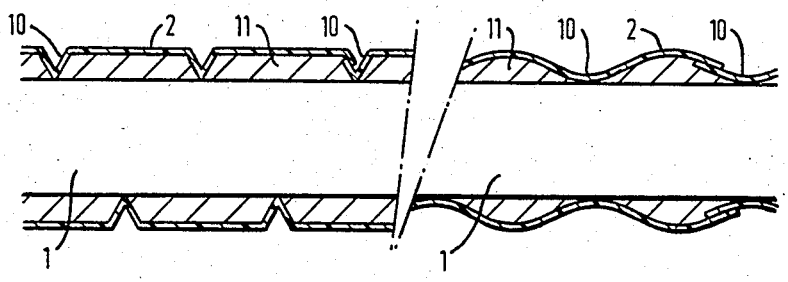
FIG. 2 is a cross-sectional view through a tendon constructed in accordance with the present invention.

A typical tendon in accordance with the invention is shown in FIG. 2 in which the strand 1 has a metal sheath 2 helically wound around it, the interlocking or lapped edges 10 of the sheath 2 projecting inwardly to near the surface of the strand 1.

Between the surface of the strand 1 and the inner surface of the sheath 2 is a material having a latent hardening property and an activator therefor. Initially, prior to tensioning of the strand, these materials will be in quiescent condition i.e., inactive. To contain these materials in the quiescent condition, they must be prevented from inter-reacting and this is achieved according to one aspect of the invention by encapsulating one of them in a myriad of small capsules which, when ruptured, enable the materials to react and the hardening process of the hardenable material to commence.

A suitable hardenable material is Bisphenol "A" epoxy resin which is emulsified with water and carried in a solvent such as toluene or a halogenated hydrocarbon. The encapsulating material may be an epoxy resin and the encapsulation technique, which produces a myriad of capsules, may result in an average capsule diameter of 15 microns.

The activator may be an aliphatic amine which, when brought into contact with the epoxy resin, will commence the hardening process.

The encapsulated epoxy resin is produced in powder or granular form, mixed with a carrier which may be a quick drying solvent, further mixed with the liquid aliphatic amine and the mixture applied by dipping, spraying or painting onto the surface of the strand and/or onto the inner surface of the sheath prior to or during helically winding the sheath around the strand. The applied material is indicated at 11 in FIG. 2.

The material thus applied will remain in quiescent condition between the strand and sheath until activated by relative movement between the strand and sheath which would normally be brought about when tensioning the strand. On tensioning, the capsules will be ruptured and release the epoxy resin into contact with the aliphatic amine. After tensioning has been completed, the epoxy resin will gradually set and when completely hardened will effectively result in a bonded tendon, i.e., the strand will be bonded to the surrounding concrete.

Figure 3:
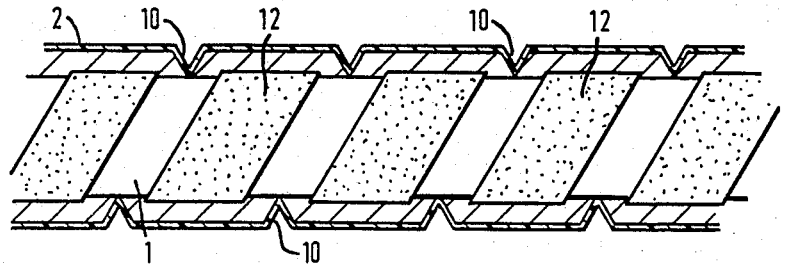
FIG. 3 is a cross-sectional view through a further form of tendon constructed in accordance with the present invention.

A further form of tendon according to the invention is shown in FIG. 3 in which the hardenable material, for example, epoxy resin as before is encapsulated, but in this embodiment is carried in a sheet 12 of material which is wrapped helically around the strand 1 during the helical winding of the sheath 2. It will be noted that the pitch of the sheet 12 is similar to the pitch of the sheath. The activator 13 is applied around the strand by painting or spraying.

On tensioning the strand, the interlocking or lapped edges 10 of the sheath will rupture the capsules in the sheet and contact will be made between the epoxy resin and amine activator and the hardening process will commence.

We claim:

1. A prestressed concrete structure comprising an elongated tubular metal sheath formed with a helically extending rib projecting radially inwardly of said tubular sheath and defining a helically extending outer groove, concrete surrounding said sheath and occupying said outer groove to secure said sheath, a high tensil strength strand provided inside said sheath such that said helically shaped internal rib of said sheath is located in closely spaced radial relationship to the outer surface of said strand, said strand outer surface and said sheath defining a generally helically shaped channel therebetween, plastic material in said helically shaped channel, said material including at least first and second components which normally react with one another to set the material in a hardened state, containment means for isolating one of said first components from said second component, said containment means being readily frangible as a result of relative longitudinal motion between said strand and said sheath rib, and means for tensioning said strand to achieve such motion and rupture said containment means to secure the tensioned strand in place inside said tubular sheath.

2. The structure of claim 1 further characterized by a lubricant in said plastic material to facilitate relative motion of said strand relative said sheath.

3. The structure of claim 1 wherein one of said components comprises an epoxy resin and the second component an aliphatic amine activator, the latter being isolated from the former by said containment means.

4. The structure of claim 1 wherein said containment means comprises a helically wrapped sheet shaped strip provided around said strand and in said helically shaped channel.

5. The structure of claim 1 wherein said containment means comprises a myriad of capsules scattered throughout said annular space, each capsule containing one of said reactive components.

6. The structure of claim 5 wherein said containment means in the form of said myriad of capsules contain an epoxy resin in granular form, and a solvent carrier for said epoxy resin so contained.

7. The structure of claim 6 wherein said epoxy resin comprises Bisphenol "A", and said second component comprising an aliphatic amine activator applied around said strand.

8. The structure of claim 7 wherein said sheath comprises a plurality of overlapping tubular segments, each segment having an inwardly tapered end portion mating with a complimentary shaped end portion of an adjacent segment, said segments being movable axially relative to one another and said adjacent end portions thereof being located adjacent said strand.

* * * * *